US011696388B2

(12) United States Patent
Umstattd et al.

(10) Patent No.: US 11,696,388 B2
(45) Date of Patent: Jul. 4, 2023

(54) PULSED NON-THERMAL ATMOSPHERIC PRESSURE PLASMA PROCESSING SYSTEM

(71) Applicant: Transient Plasma Systems, Inc., Torrance, CA (US)

(72) Inventors: Ryan J. Umstattd, Virginia Beach, VA (US); Jason M. Sanders, Los Angeles, CA (US); Mark Thomas, Torrance, CA (US); Patrick Ford, Torrance, CA (US); Daniel Singleton, Hermosa Beach, CA (US)

(73) Assignee: TRANSIENT PLASMA SYSTEMS, INC., Torrance, CA (US)

( * ) Notice: Subject to any disclaimer, the term of this patent is extended or adjusted under 35 U.S.C. 154(b) by 434 days.

(21) Appl. No.: 16/861,658

(22) Filed: Apr. 29, 2020

(65) Prior Publication Data

US 2020/0359491 A1 Nov. 12, 2020

Related U.S. Application Data

(60) Provisional application No. 62/844,574, filed on May 7, 2019, provisional application No. 62/844,587, filed on May 7, 2019.

(51) Int. Cl.
*H05H 1/24* (2006.01)

(52) U.S. Cl.
CPC ..... *H05H 1/2418* (2021.05); *H05H 1/2406* (2013.01)

(58) Field of Classification Search
None
See application file for complete search history.

(56) References Cited

U.S. PATENT DOCUMENTS 3,660,685 A 5/1972 Berger
3,832,568 A 8/1974 Wang
(Continued)

FOREIGN PATENT DOCUMENTS

CN 201715597 U 1/2011
CN 202524634 U 11/2012
(Continued)

OTHER PUBLICATIONS

Extended European Search Report, dated Sep. 20, 2021, for European Application No. 19741949.2-1211, 5 pages.
(Continued)

*Primary Examiner* — Srinivas Sathiraju
(74) *Attorney, Agent, or Firm* — Cozen O'Connor

(57) ABSTRACT

A system for generating and delivering a low temperature, wide, partially ionized tunable plasma stream is described. The system employs a fast rising, repetitive high voltage pulse generator, flowing gas, and a plasma head to produce the described atmospheric pressure plasma stream and its associated active species. The plasma head may have an exit slit with a relatively wide dimension to produce a relative wide plasma stream. Electrodes may be located proximate the exit slit, for example one in an interior of the plasma head via with gas flows toward the exit slit, and the other exterior to the plasma head and offset from the exit slit. The plasma may include baffle material to enhance a uniformity of flow through and across the exit slit. Plasma heads with having exit slit with different widths may be provided as a kit.

20 Claims, 5 Drawing Sheets

(56) References Cited

U.S. PATENT DOCUMENTS 4,433,669 A 2/1984 Ishikawa et al.
4,677,960 A 7/1987 Ward
5,157,267 A 10/1992 Shirata et al.
5,563,780 A 10/1996 Goad
5,825,038 A * 10/1998 Blake ..... H01J 37/3007 250/492.21
5,909,280 A * 6/1999 Zavracky ..... G01J 3/26 356/454
6,140,773 A * 10/2000 Anders ..... H05H 1/466 315/111.21
6,235,249 B1 5/2001 Chen
6,317,341 B1 11/2001 Fraidlin et al.
6,426,666 B1 7/2002 Li et al.
6,633,017 B1 10/2003 Drummond et al.
6,831,377 B2 12/2004 Yampolsky et al.
6,906,280 B2 6/2005 Rosocha
7,767,433 B2 8/2010 Kuthi et al.
7,817,396 B2 10/2010 Tao et al.
7,901,929 B2 3/2011 Kuthi et al.
7,901,930 B2 3/2011 Kuthi et al.
8,115,343 B2 2/2012 Sanders et al.
8,120,207 B2 2/2012 Sanders et al.
8,212,541 B2 7/2012 Perreault et al.
8,226,901 B2 7/2012 Makita et al.
8,373,088 B2 2/2013 Kang
8,418,668 B2 4/2013 Shimizu
8,586,918 B2 * 11/2013 Brucker ..... H01J 49/0063 250/281
8,854,019 B1 10/2014 Levesque et al.
8,908,401 B2 12/2014 Hiltbrunner et al.
9,080,547 B2 7/2015 Shiraishi et al.
9,339,783 B2 * 5/2016 Fridman ..... H05H 1/2406
9,377,002 B2 * 6/2016 Singleton ..... H01T 13/50
9,472,382 B2 * 10/2016 Jacofsky ..... H01J 37/3244
9,521,736 B2 * 12/2016 Jacofsky ..... A61N 1/44
9,572,241 B1 * 2/2017 Eckert ..... H05H 1/2406
9,617,965 B2 * 4/2017 Sanders ..... F02P 3/0838
9,826,618 B2 * 11/2017 Eckert ..... A61B 18/042
9,831,776 B1 11/2017 Jiang et al.
10,072,629 B2 9/2018 Sanders et al.
10,128,745 B2 11/2018 Low et al.
10,587,188 B2 * 3/2020 Sanders ..... H02M 3/156
10,631,395 B2 * 4/2020 Sanders ..... H01J 37/32146
10,924,006 B1 * 2/2021 Giuliano ..... H02M 3/073
10,925,144 B2 * 2/2021 Hochwalt ..... A61N 1/0476
11,102,877 B2 * 8/2021 Eckert ..... A61B 90/80
11,149,370 B2 * 10/2021 Cornelius ..... D06B 19/007
11,166,762 B2 * 11/2021 Eckert ..... A61B 5/0507
11,230,776 B2 * 1/2022 Mills ..... H02S 40/38
2001/0042372 A1 11/2001 Khair
2003/0106788 A1 * 6/2003 Babko-Malyi .... H01J 37/32541 422/186
2003/0116148 A1 6/2003 Sakakura
2004/0022669 A1 * 2/2004 Ruan ..... A61M 1/3681 422/22
2004/0182832 A1 9/2004 Rosocha
2005/0133927 A1 * 6/2005 Rosocha ..... H01J 37/32009 438/162
2005/0218423 A1 10/2005 Shimizu et al.
2005/0279337 A1 12/2005 Biljenga
2006/0062074 A1 3/2006 Gundersen et al.
2007/0031959 A1 2/2007 Kuthi et al.
2007/0262721 A1 11/2007 Camilli
2008/0231337 A1 9/2008 Krishnaswamy et al.
2008/0274632 A1 11/2008 Lenfert et al.
2009/0068375 A1 * 3/2009 Dobbyn ..... C23C 4/134 427/569
2009/0126668 A1 5/2009 Shiraishi et al.
2009/0126684 A1 5/2009 Shiraishi et al.
2009/0200948 A1 * 8/2009 Selwyn ..... H05H 1/4697 315/111.21
2010/0038971 A1 2/2010 Sanders et al.
2010/0084980 A1 4/2010 Koo
2010/0156195 A1 6/2010 Sanders et al.
2011/0069514 A1 3/2011 Chiba
2011/0267113 A1 11/2011 Carmon et al.
2012/0039747 A1 2/2012 Morfill et al.
2013/0318846 A1 * 12/2013 Atwood ..... G09F 21/026 40/636
2014/0097338 A1 * 4/2014 Eiler ..... H01J 49/04 250/288
2014/0109886 A1 4/2014 Singleton et al.
2014/0230770 A1 8/2014 Kuthi et al.
2014/0346875 A1 11/2014 Chinga et al.
2015/0167623 A1 * 6/2015 Sanders ..... F02P 9/007 123/638
2015/0280553 A1 * 10/2015 Giuliano ..... H02M 3/07 323/282
2016/0069320 A1 3/2016 Idicheria et al.
2016/0129142 A1 * 5/2016 Nettesheim ..... A61L 2/14 315/111.21
2016/0254754 A1 9/2016 Perreault et al.
2017/0084446 A1 * 3/2017 Murphy ..... H01J 49/408
2017/0104426 A1 * 4/2017 Mills ..... H01L 31/0549
2017/0354453 A1 * 12/2017 Krasik ..... A61B 18/042
2018/0268358 A1 * 9/2018 Alden ..... G07C 9/00174
2018/0269793 A1 * 9/2018 Ahsanuzzaman ..... H02M 3/33523
2018/0361047 A1 * 12/2018 Gillespie ..... B65B 69/0091
2018/0363124 A1 * 12/2018 Yancey ..... B32B 37/12
2019/0032623 A1 1/2019 Idicheria et al.
2019/0124754 A1 * 4/2019 Schmidt-Bieker ..... A61C 19/06
2019/0229615 A1 * 7/2019 Sanders ..... H02M 3/156
2019/0229623 A1 * 7/2019 Tsuda ..... H02M 3/073
2019/0230779 A1 * 7/2019 Sanders ..... H01J 37/32174
2020/0023308 A1 * 1/2020 Cronin ..... B01D 53/346
2020/0025393 A1 * 1/2020 Cronin ..... B01J 19/08
2020/0359491 A1 * 11/2020 Umstattd ..... H05H 1/2439
2021/0031436 A1 * 2/2021 Ramia ..... B33Y 10/00

FOREIGN PATENT DOCUMENTS

CN 105207256 A 12/2015
CN 105673139 A 6/2016
JP 2005235448 A 9/2005
JP 2006081277 A 3/2006
JP 2010518555 A 5/2010
JP 2012184718 A 9/2012
JP 2013144127 A 7/2013
KR 10-1995-0003730 2/1995
KR 20100023304 A 3/2010
KR 20100046734 A 5/2010
KR 101846046 B1 4/2018
WO 2004049769 A1 6/2004
WO 2005027191 A2 3/2005
WO 2008055337 A1 5/2008
WO 2010011408 A1 1/2010
WO WO-2012010299 A1 * 1/2012 ..... B05D 1/62
WO 2013134573 A1 9/2013
WO 2014066095 A1 5/2014
WO 2015095140 A1 6/2015
WO 2016079742 A1 5/2016
WO 2019143992 A1 7/2019
WO 2019144037 A1 7/2019

OTHER PUBLICATIONS

Li, Amin , et al., "Gene Expressions Networks Underlying Retinoic Acid-Induced Differentiation of Human Retinoblastoma Cells", Investigative Ophthalmology & Visual Science, Mar. 2003; vol. 44, No. 3, pp. 996-1007.

Li, Aimin , et al., "Retinoic Acid Upregulates Cone Arrestin Expression in Retinoblastoma Cells through a Cis Element in the Distal Promoter Region", Investigative Ophthalmology & Visual Science, May 2002; vol. 43, No. 5, pp. 1375-1383.

Lyubutin, S.K. , et al., "Repetitive Nanosecond All-Solid-State Pulsers Based on SOS Diodes", Institute of Electrophysics; Russian Academy of Sciences, Ural Division; IEEE 11th International Pulsed Power Conference, Baltimore, MD; pp. 992-998.

Marcu, Laura , et ai., "Photobleaching of Arterial Fluorescent Compounds: Characterization of Elastin, Collagen and Cholesterol

(56) References Cited

OTHER PUBLICATIONS

Time-resolved Spectra during Prolonged Ultraviolet Irradiation", Photochemistry and Photobiology, 1999; vol. 69, No. 6, pp. 713-721.
Marszalek, Piotr , et al., "Schwan equation and transmembrane potential induced by alternating electric field", Biophysical Journal, Oct. 1990; vol. 58, pp. 1053-1058.
Matsumoto, Takao , et al., "Energy Efficiency Improvement of Nitric Oxide Treatment Using Nanosecond Pulsed Discharge", IEEE Transactions on Plasma Science; vol. 38, No. 10, Oct. 2010; pp. 2639-2643.
Matsumoto, Takao , et al., "Process Performances of 2 ns Pulsed Discharge Plasma", Japanese Journal of Applied Physics vol. 5, No. 8, Aug. 1, 2011.
Maytin, Edward V., et al., "Stress-Inducible Transcription Factor CHOP/gadd153 Induces Apoptosis in Mammalian Celis via p38 Kinase-Dependent and -independent Mechanisms", Experimental Cell Research, 2001: vol. 267, pp. 193-204.
McDonald, Jacob D., et al., "Emissions from Charbroiling and Grilling of Chicken and Beef", Journal of the Air & Waste Management Association, 2003; vol. 53, No. 2, pp. 185-194.
Mohapatro, Sankarsan , et al., "Nanosecond pulse discharge based nitrogen oxides treatment using different electrode configurations", The Institution of Engineering and Technology, vol. 2, No. s 2, Jun. 1, 2017, 60-68.
Moll, John L., et al., "Physical Modeling of the Step Recovery Diode for Pulse and Harmonic Generation Circuits", Proceedings of the IEEE, Jul. 1969; vol. 57, No. 7, pp. 1250-1259.
Oberdorster, Gunter , et al., "Nanotoxicology: An Emerging Discipline Evolving from Studies of Ultrafine Particles", Environmental Health Perspectives, vol. 113, No. 7; Jul. 2005; pp. 823-839.
Perryman, Pamela , "Preliminary Draft Staff Report: Proposed Amended Rule 1138—Control of Emissions from Restaurant Operations", South Coast Air Quality Management District; Planning, Rule Development, and Area Sources, Aug. 2009, in 27 pages.
Pogue, Brian W., et al., "In Vivo NADH Fluorescence Monitoring as an Assay for Cellular Damage in Photodynamic Therapy", Photochemistry and Photobiology, 2001; vol. 74, No. 6, pp. 817-824.
Polevaya, Yulia , et al., "Time domain dielectric spectroscopy study of human cells II. Normal and malignant white blood cells", Biochimica et Biophysica Acta, 1999; vol. 1419, pp. 257-271.
Pope III, C. Arden , et al., "Lung Cancer, Cardiopulmonary Mortality, and Long-term Exposure to Fine Particulate Air Pollution", JAMA, Mar. 6, 2002; vol. 287, No. 9, pp. 1132-1141.
Rajanikanth, B.S. , et al., "Discharge Plasma Treatment for NOx Reduction from Diesel Engine Exhaust: A Laboratory Investigation", IEEE Transactions on Dielectrics and Electrical Insulation, vol. 12, No. 1; Feb. 2005, pp. 72-80.
Rukin, S.N. , "High-Power Nanosecond Pulse Generators Based on Semiconductor Opening Switches (Review)", Instruments and Experimental Techniques, 1999; vol. 42, No. 4, pp. 439-467.
Samet, Jonathan M., et al., "Fine Particulate Air Pollution and Mortality in 20 U.S. Cities, 1987-1994", The New England Journal of Medicine, Massachusetts Medical Society; Dec. 14, 2000; vol. 343, No. 24, pp. 1742-1749.
Sanders, J. , et al., "Broadband Power Measurement of High-Voltage, Nanosecond Electric Pulses for Biomedical Applications", IEEE International Power Modulator Conference, Las Vegas, NV, 2008; pp. 350-353.
Schoenbach, Karl H., et al., "The Effect of Pulsed Electric Fields on Biological Cells: Experiments and Applications", IEEE Transactions on Plasma Science, Apr. 1997; vol. 25, No. 2, pp. 284-292.
Tang, Tao , et al., "Diode Opening Switch Based Nanosecond High Voltage Pulse Generators for Biological and Medical Applications", IEEE Transactions on Dielectrics and Electrical Insulation, Aug. 2007; vol. 14, No. 4; pp. 878-883.
Wakita, Masayoshi , et al., "Some Characteristics of the Fluorescence Lifetime of Reduced Pyridine Nucleotides in Isolated Mitochondria, Isolated Hepatocytes, and Perfused Rat Liver in Situ", J. Biochem., 1995; vol. 118, No. 6, pp. 1151-1160.
Wang, Fei , et al., "Solid-State High Voltage Nanosecond Pulse Generator", IEEE Pulsed Power Conference, Abstract No. 10123, pp. 1199-1202.
Watanabe, Kenji , et al., "Feasibility and limitations of the rat model by C6 gliomas implanted at the subcutaneous region", Neurological Research; Jul. 2002, vol. 24, No. 5; pp. 485-490.
Weaver, James C., et al., "Theory of electroporation: A review", Bioelectrochemistry and Bioenergetics, 1996; vol. 41, pp. 135-160.
Webb, S.E.D. , et al., "A wide-field time-domain fluorescence lifetime imaging microscope with optical sectioning", Review of Scientific Instruments, Apr. 2002; vol. 73, No. 4, pp. 1898-1907.
Weiss, Arthur , et al., "The role of T3 surface molecules in the activation of human t cells: a two-stimulus requirement for IL 2 production reflects events occurring at a pre-translationai level", The Journal of Immunology, vol. 133, No. 1; Jul. 1984, pp. 123-128.
Yamashita, H. , et al., "Characteristics of negative-polarity DC superimposed nanosecond discharge and its applications", 2019 IEEE Pulsed Power & Plasma Sciences (PPPS), Jun. 23, 2019, 1-4.
Yancey, J.W.S. , et al., "Cookery method and endpoint temperature can affect the Warner-Bratzler shear force, cooking loss, and Internal cooked color of beef semimembranosus and infraspinatus steaks", J. Anim. Sci. 2016, vol. 94, pp. 4434-4446.
Zhu, Xuemei , et al., "Mouse cone arrestin gene characterization: promoter targets expression to cone photoreceptors", FEBS Letters, 2002; vol. 524, pp. 116-122.
Zhu, Xuemei , et al., "The Carboxyl Terminal Domain of Phosducin Functions as a Transcriptional Activator", Biochemical and Biophysical Research Communications, 2000; vol. 270, pp. 504-509.
Extended European Search Report dated Jul. 16, 2021 for corresponding EP Application No. 19838770.6, 27 pages.
PCT Search Report and Written Opinion from PCT Application No. PCT/US2013/064955 issued from The Korean Intellectual Property Office dated Jan. 21, 2014.
Extended European Search Report.
Extended European Search Report for European Application No. 09800737.0 dated Apr. 25, 2014 in 10 pages.
Hewlett Packard. Application Note 918, Pulse and Waveform Generation with Step Recovery Diodes. Oct. 1984. 28 pages.
International Search Report & Written Opinion for PCT/US2020/030540, dated Aug. 12, 2020, 12 pages.
International Search Report and Written Opinion for PCT/US2013/064955 dated Jan. 21, 2014 in 7 pages.
International Search Report and Written Opinion for PCT/US2019/014273 dated May 9, 2019 in 10 pages.
International Search Report and Written Opinion for PCT/US2019/014339 dated May 8, 2019 in 11 pages.
International Search Report and Written Opinion for PCT/US2019/041228, dated Nov. 12, 2019, 10 pages.
International Search Report for PCT/US2014/070518, dated Mar. 31, 2015, 2 pages.
International Search Report from PCT Application No. PCT/US2009/045073 dated Jan. 28, 2010 in 2 pages.
Kuthi, Andras, U.S. Appl. No. 61/767,044, filed Feb. 20, 2013, "Transient Plasma Electrode for Radical Generation." 7 pages.
Written Opinion for PCT/US2014/070518, dated Mar. 31, 2015, 4 pages.
Babaie, Meisam , et al., "Effect of Pulsed Power on Particle Matter in Diesel Engine Exhaust Using a DBD Plasma Reactor", IEEE Transactions on Plasma Science, vol. 41, No. 8; Aug. 2013, pp. 2349-2358.
Babaie, M. , et al., "Influence of non-thermai plasma after-treatment technology on diesel engine particulate matter composition and NOx concentration", Int. J. Environ. Sci. Technol. 2016, vol. 13; pp. 221-230.
Barth, Rolf F., "Rat brain tumor models in experimental neuro-oncology: The 9L, C6, T9, F98, RG2 (D74), RT-2 and CNS-1 Gliomas", Journal of Neuro-Oncology, 1998; vol. 36, pp. 91-102.
Behrend, M.R. , et al., "Nanosecond Pulse Generator Using Fast Recovery Diodes for Cell Electromanipulation", IEEE Transactions on Plasma Science, IEEE Service Center, Piscataway, New Jersey; vol. 33, No. 4, Aug. 1, 2005, pp. 1192-1197.

(56) References Cited

OTHER PUBLICATIONS

Bier, Martin , et al., "Kinetics of Sealing for Transient Electropores in isolated Mammalian Skeletal Muscle Cells", Bioeiectromagnetics, vol. 20, 1999; pp. 194-201.
Borner, Markus M., et al., "The detergent Triton X-100 induces a death pattern in human carcinoma cell lines that resembles cytotoxic lymphocyte-induced apoptosis", FEBS Letters (1994), vol. 353, pp. 129-132.
Chae, J.-O. , "Non-thermal plasma for diesel exhaust treatment", Journal of Electrostatics, Siesvier Science B.V., vol. 57, 2003, pp. 251-262.
Chang, J.S. , "Physics and chemistry of plasma pollution control technology", Plasma Sources Science and Technology; IOP Publishing, vol. 17, 2008; pp. 1-6.
Chow, Judith C., et al., "Health Effects of Fine Particulate Air Pollution: Lines that Connect", Journal of the Air & Waste Management Association, 2006; vol. 56, No. 10, pp. 1368-1380.
Cole, M.J. , et al., "Time-domain whole-field fluorescence lifetime imaging with optical sectioning", Journal of Microscopy, vol. 203, Pt 3, Sep. 2001, pp. 246-257.
Cossarizza, Andrea , et al., "Chapter 21: Analysis of Mitochondria during Cell Death", Methods in Cell Biology, vol. 63, 2001; pp. 467-486.
Craft, Cheryl M., et al., "PhLPs and PhLOPs in the Phosducin Family of G beta gamma Binding Proteins", Biochemistry, American Chemical Society, 1998; vol. 37, pp. 15758-15772.
Cubeddu, R. , et al., "Time-resolved fluorescence imaging in biology and medicine", Topical Review; Institute of Physics Publishing, Journal of Physics D: Applied Physics; vol. 35, 2002; pp. R61-R76.
Deangelis, Lisa M., "Brain Tumors", New England Journal of Medicine, Jan. 11, 2001; vol. 344, No. 2, pp. 114-123.
Debruin, Katherine A., et al., "Modeling Electroporation in a Single Cell. I. Effects of Field Strength and Rest Potential", Biophysical Journal, Sep. 1999; vol. 77, pp. 1213-1224.
Dockery, Douglas W., et al., "An Association Between Air Pollution and Mortality in Six U.S. Cities", The New England Journal of Medicine; Dec. 9, 1993; vol. 329, No. 24, pp. 1753-1759.
Frank, K. , et al., "High-Power Pseudospark and BLT Switches", IEEE Transactions on Plasma Science, European Organization for Nuclear Research, Apr. 1988; vol. 16, No. 2, pp. 317-323.
Freeman, Scott A., et al., "Theory of Electroporation of Planar Bilayer Membranes: Predictions of the Aqueous Area, Change in Capacitance, and Pore-Pore Separation", Biophysical Journal, Jul. 1994; vol. 67, pp. 42-56.
Garon, E.B. , et al., 2007 In Vitro and In Vivo Evaluation and a Case Report of Intense Nanosecond Pulsed Electric Field as a Local Therapy for Human Malignancies. Int. J. Cancer, vol. 121: pp. 675-682.
Gilbert, Richard A., "Novel Electrode Designs for Electrochemotherapy", Biochimica et Biophysica Acta 1334, 1997, 9-14.
Gotoh, Tomomi , et al., "Nitric Oxide-induced Apoptosis in RAW 264.7 Macrophages Is Mediated by Endoplasmic Reticulum Stress Pathway involving ATF6 and CHOP", The Journal of Biological Chemistry, The American Society for Biochemistry and Molecular Biology, Inc.; 2002; vol. 277, No. 14, pp. 12343-12350.
Grekhov, I.V, , et al., "Formation of nanosecond high-voltage drops across semiconductor diodes with voltage recovery by a drift mechanism", Sov. Tech. Phys. Lett., 1983; vol. 9, No. 4, pp. 188-189.
Grekhov, I.V. , et al., "Nanosecond semiconductor diodes for pulsed power switching", Physics-Uspekhi, Russian Academy of Sciences, 2005; vol. 48, No. 7; pp. 703-712.
Grekhov, Igor V., et al., "Physical Basis for High-Power Semiconductor Nanosecond Opening Switches", IEEE Transactions on Plasma Science, Oct. 2000; vol. 28, No. 5, pp. 1540-1544.
Gundersen, M. , et al., "Nanosecond Pulse Generator Using a Fast Recovery Diode", IEEE 26th Power Modulator Conference, 2004; pp. 603-606.
Gysel, Nicholas , et al., "Particulate matter emissions and gaseous air toxic pollutants from commercial meat cooking operations", Journal of Environmental Sciences; The Research Center for Eco-Environmental Sciences, Chinese Academy of Sciences; vol. 65, 2018, pp. 162-170.
Hackam, R. , et al., "Air Pollution Control by Electrical Discharges", IEEE Transactions on Dielectrics and Electrical Insulation, vol. 7, No. 5, Oct. 2000, pp. 654-683.
Hemker, R.G. , et al., "Development of a Parallel Code for Modeling Plasma Based Accelerators", Proceedings of the 1999 Particle Accelerator Conference, New York, 1999; pp. 3672-3674.
Huiskamp, T. , et al., "Matching a Nanosecond Pulse Source to a Streamer Corona Plasma Reactor With a DC Bias", IEEE Transactions on Plasma Science, vol. 43, No. 2, Feb. 1, 2015, 617-624.
Joshi, R.P. , et al., "Electroporation Dynamics in Biological Cells Subjected to Ultrafast Electrical Pulses: A Numerical Simulation Study", Physical Review E, vol. 62, No. 1; Jul. 2000; pp. 1025-1033.
Kaltsonoudis, Christos , et al., "Characterization of fresh and aged organic aerosol emissions from meat charbroiling", Atmospheric Chemistry and Physics, vol. 17, 2017; pp. 7143-7155.
Kirkman, George F., et al., "Low pressure, light initiated, glow discharge switch for high power applications", Appl. Phys. Lett.; American Institute of Physics, 1986; vol. 49, pp. 494-495.
Kotnik, Tadej , et al., "Theoretical Evaluation of the Distributed Power Dissipation in Biological Cells Exposed to Electric Fields", Bioeiectromagnetics, vol. 21; 2000; pp. 385-394.
Kotov, Yu A., et al., "Novel nanosecond semiconductor opening switch for megavolt repetitive pulsed power technology: experiment and applications", In Proceedings of the 9th Int. IEEE Pulsed Power Conference, Albuquerque, NM, 1993; SPIE vol. 2374; pp. 98-103.
Kuroki, Tomoyuki , et al., "Single-Stage Plasma-Chemical Process for Particulates, Nox, and SOx Simultaneous Removal", IEEE Transactions on Industry Applications, vol. 38, No. 5, Sep./Oct. 2002, pp. 1204-1209.
Kuthi, A. , et al., "Nanosecond pulse generator using a fast recovery diode", Power Modulator Symposium, 2004 and 2004 High-Voltage Workshop. Conference Record of the 26th International San Francisco, CA May 23-26, 2004 IEEE, pp. 603-606.
Lee, Jun-Bok , et al., "Emission Rate of Particulate Matter and Its Removal Efficiency by Precipitators in Under-Fired Charbroiling Restaurants", TheScientificWorldJournal, TSW Environment; 2011, vol. 11, pp. 1077-1088.
Communication Pursuant to Article 94(3) EPC, dated Dec. 8, 2022, for European Application No. 20197970.5, 7 pages.
Extended European Search Report, dated Jan. 2, 2023, for corresponding European Application No. 20801583.4, 9 pages.
Yamashita H et al: "Characteristics of negative-polarity DC superimposed nanosecond pulsed discharge and its applications", 2019 IEEE Pulsed Power & Plasma Science (PPPS), IEEE, Jun. 23, 2019, pp. 1-4.

* cited by examiner

PULSED NON-THERMAL ATMOSPHERIC PRESSURE PLASMA PROCESSING SYSTEM

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This description relates to a system to produce a wide beam of non-thermal, atmospheric pressure partially ionized plasma with tunable properties using repetitive, fast rising electrical pulses.

BACKGROUND

Thermal atmospheric-pressure plasmas of large and small size are used for a variety of cleaning, coating, cutting and joining applications, but their high temperatures (many 1000's of degrees Celsius) limit their utility to materials that can withstand those high temperatures.

SUMMARY

In order to broaden the applicability of the useful chemistries driven by atmospheric plasmas, a system for generating and delivering a wide beam of non-thermal, low temperature (below 50 degrees Celsius) partially ionized plasma with tunable properties has been developed based upon repetitive, fast rising, high voltage electrical pulses and a directed, high speed flow of gas. By using fast rising (greater than 100 V/ns), short duration (<100 ns) pulses, one generates a non-equilibrium plasma in which electrons receive the majority of the delivered pulse energy; the much heavier ion and neutral species in the plasma move too slowly to be directly effected by the fast electrical pulses. Increasing the energy of the electrons opens the door to new chemical pathways in atmospheric pressure plasma treatment, and limiting the energy delivered to the ions and other species reduces the amount of waste heat generated resulting in a much lower temperature output flow.

Briefly and in general terms, the present disclosure is directed to systems and methods to generate a wide beam of near-room temperature plasma using repetitive fast rising high voltage pulses. In the disclosed implementations, the fast rising pulses are transmitted to a plasma head via a coaxial cable. A source (e.g., fan, blower, compressor, reservoir of compressed gas) provides a moving stream of gas. The pulses are applied to the moving stream of gas via electrodes located at the plasma head. The partially ionized plasma that exits the head and its associated active species can be used to perform a variety of surface treatments such as cleaning, activation, disinfection, etching, and coating.

The system may optionally include an adjustable voltage output, an adjustable pulse repetition frequency, and an adjustable flow rate for one or more input gases. The input gas can be a noble gas such as helium or argon for achieving the lowest plasma stream temperatures near room temperature. Compressed air can also be used but with an attendant increase in the plasma stream temperature. The efficacy of the plasma can be tuned or optimized for each application by adjusting the amplitude of the voltage pulse, the repetition rate of the pulses, the velocity or composition of the flowing gas, or a combination thereof. While other atmospheric pressure plasma systems can also be used for cleaning, activation, disinfection, etching, and coating, their ability to optimize their performance for the specific application on a specific substrate is quite limited. For example, most atmospheric pressure plasma systems driven by an alternating voltage signal at a fixed frequency have only 2 or 3 output power settings which change the amount of energy pumped into the plasma. By using repetitive fast rising high voltage pulses, one can smoothly and independently tune key plasma features: increasing the pulse voltage (and the rate of voltage rise) creates different, higher energy radicals and active species, while increasing the pulse repetition rate raises the average number density of these usually short-lived active species.

In some implementations, a dimension (e.g., width) of the electrodes of the plasma head can be selected (e.g., more narrow or more wide) depending on the desired width of the plasma stream. In some implementations, the electrodes may be selectively replaceable in the plasma head, for example allowing an end user to select electrodes of a certain dimension to achieve a desired width of plasma, for instance based on a specific application for which the plasma will be employed. In some implementations, the plasma head may be selectively replaceable, allowing an end user to select a plasma head with electrodes of defined size to achieve a desired width of plasma, for instance based on a specific application for which the plasma will be employed.

The foregoing summary does not encompass the claimed subject matter in its entirety, nor are the illustrated or described implementations and embodiments intended to be limiting. Rather, the illustrated or described implementations and embodiments are provided as mere examples.

Other features of the disclosed implementations or embodiments will become apparent from the following detailed description, taken in conjunction with the accompanying drawings, which illustrate, by way of example, the principles of the disclosed implementations and embodiments.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION OF THE PREFERRED EMBODIMENTS

In the following description, certain specific details are set forth in order to provide a thorough understanding of various disclosed implementations and embodiments. However, one skilled in the relevant art will recognize that embodiments may be practiced without one or more of these specific details, or with other methods, components, materials, etc. In other instances, well-known structures associated with plasma generation and gas delivery systems have not been shown or described in detail to avoid unnecessarily obscuring descriptions of the implementations and embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one implementation" or "an implementation" or "one embodiment" or "an embodiment" means that a particular feature, structure or characteristic described in connection with the implementation or embodiment is included in at least one implementation or embodiment. Thus, the appearances of the phrases "one implementation" or "an implementation" or "in one embodiment" or "in an embodiment" in various places throughout this specification are not necessarily all referring to the same implementation or embodiment. Furthermore, the particular features, structures, or characteristics may be combined in any suitable manner in one or more implementations or embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the implementations or embodiments.

The present disclosure relates to means of generating a low temperature (less than 50 degrees Celsius) wide plasma stream.

Figure 1:
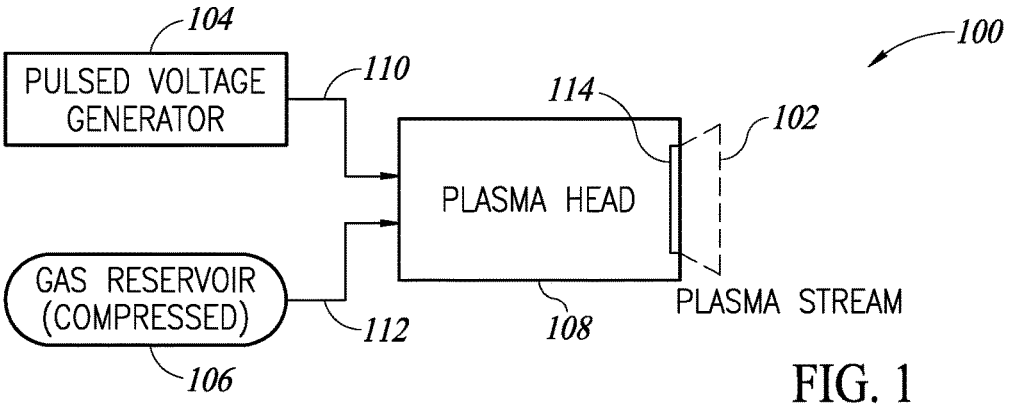
FIG. 1 is a schematic diagram showing a plasma treatment system, operable to generate low temperature plasma according to at least one illustrated implementation.

FIG. 1 shows a plasma treatment system 100 according to at least one illustrated implementation, operable to generate a low temperature wide plasma stream 102 by using a repetitive, fast rising, pulsed voltage generator 104, a source of gas 106, and a plasma head 108.

The pulsed voltage generator 104 of plasma treatment system 100 includes a power supply 200 (FIG. 2) operable to generate fast rising high voltage pulses. The voltage pulses are delivered to the plasma head 108, preferably by the coaxial cable 110.

The source of gas 106 of the plasma treatment system 100 may take a variety of forms that provide one a flow or flows of one or more gases to, or at least proximate, the plasma head 108. The source of gas 106 may, for example take the form of one or more reservoirs of compressed gas(es) and one or more compressors operable and fluidly coupled to increase a pressure of gas(es) in the reservoir(s), Alternatively or additionally, the source of gas 106 may include one or more fans, blowers or air movers operable to produce a stream or flow of gas(es). In at least some implementations, the plasma treatment system 100 may include one or more conduits 112 (e.g., hollow tubing) to deliver one or more gases (e.g., compressed gases) to the plasma head 108.

The supplied gas can be a noble gas (such as helium or argon) or compressed air and is provided at flow rates from 0.5 to 50 standard liters per minute (typically 5 SLPM). The flow rate should be high enough to provide a fast-moving gas channel that helps extend the plasma out from the plasma head 108 and into open air, but excessively high flow rates result in turbulent flow that causes the flow to quickly mix with ambient air upon exiting the plasma head 108 thereby quenching the plasma 102. Excessively small flow rates prevent the plasma 102 from extending past the plasma head 108 which limits the ability of the plasma 102 to reach and treat surfaces. The gas may include small amounts (1-5%) of reactive gases (such as oxygen or nitrogen) to encourage desired activation, cleaning, etching or disinfection chemistry in and around the plasma stream 102. Alternatively, the gas may include precursor chemicals that, after being mixed and energized in the plasma stream 102, are subsequently deposited on a substrate to form a desired coating. These precursor chemicals can be destroyed by the plasma 102 if it is too energetic, or they may fail to coat properly if the plasma 102 is not sufficiently energetic. It is important advantage of the described approach to be able to tune the plasma 102 properties in order to achieve the desired coating characteristics.

The plasma head 108 of the plasma treatment system 100 applies the incoming voltage pulses to the stream of moving gas. The electric field created by the voltage pulse is sufficient to ionize a small portion of the gas. The energetic free electrons drive reactions which create excited and reactive species from the surrounding air. The gas then exits the plasma head 108 via a wide exit slit 114 as a combination of charged and neutral particles that includes excited and reactive species.

Figure 2:
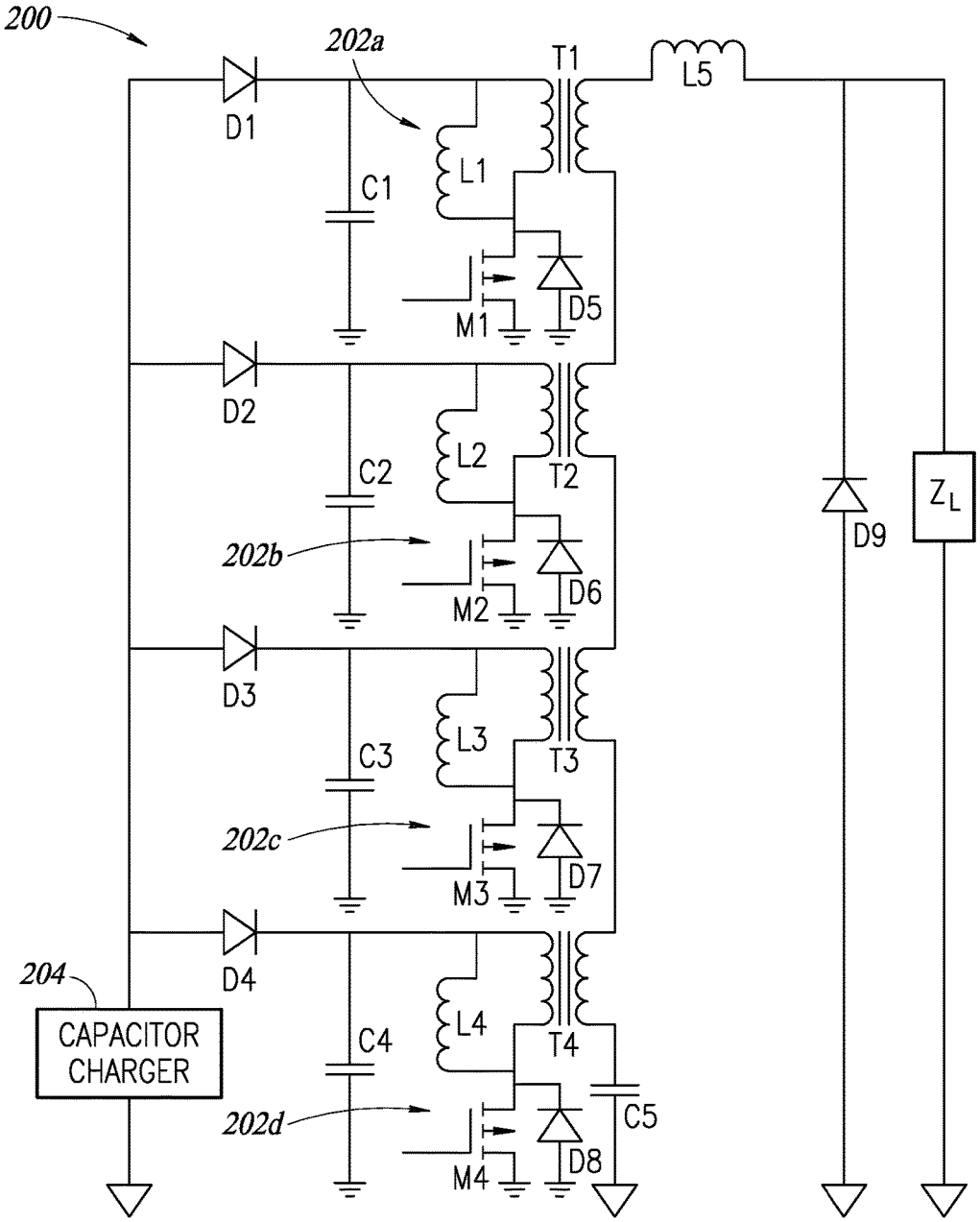
FIG. 2 is a circuit diagram showing a drive circuit suitable for inclusion in the fast rising pulse generator of FIG. 1, according to at least one illustrated implementation, the illustrated drive circuit operable to generate the repetitive, high voltage, nanosecond duration electrical pulses used to generate the plasma.

FIG. 2 shows a drive circuit 200 that is operable to generate a fast rising high voltage pulse to drive a plasma treatment system 100 (FIG. 1), for example the system illustrated in FIG. 1. A series of inductively coupled switching stages 202*a*, 202*b*, 202*c*, 202*d* (only four shown, collectively 202) discharge capacitors C1, C2, C3, C4 in series to achieve voltage multiplication. The discharge capacitors C1, C2, C3, C4 are charged via a capacitor charger 204. The switching stages 202 each include a respective transformer T, T2, T3, T4, inductor L1, L2, L3, L4, operating switches M1, M2, M3, M4, and are coupled to ground via respective diodes D5, D6, D7, D8. Operating switches M1, M2, M3, M4 causes energy to flow from these capacitors C1, C2, C3, C4 to energize a drift step recovery diode D9, which rapidly interrupts energy stored by a charge circuit inductor L5 to produce a high power, high voltage electrical pulse, which is transmitted via coaxial cable 110 to electrodes of the plasma head 108.

The output of the pulse generator 104 may be of variable amplitude between 1 and 20 kV, but typically operates near 10 kV. The pulse generator 104 generates pulses that are less than 100 nanoseconds in duration, typically between 5 and 20 ns. These pulses repeat at a frequency between single shot up to 100 kHz, but typically in the range of 1 kHz. The average electrical power delivered to the electrodes of the plasma head 108 can range from a few Watts (for narrow plasma heads or mild plasma treatments) to 250 Watts (for wider plasma heads or more intense plasma streams). This approach is in contrast to available AC-driven plasma sources which typically require higher power, generate higher temperatures, and result in more narrow plasma streams with narrower windows of operation for the plasma parameters. By adjusting a combination of the applied voltage, the pulse repetition rate and the gas flow, the plasma stream can achieve various levels of strength with respect to numbers and types of reactive species (e.g., ozone, OH, excited oxygen, excited nitrogen). Thus, this plasma treatment system 100 (FIG. 1) is capable of providing gentle treatments on sensitive substrates as well as intense treatments for more robust substrates. This plasma treatment system 100 is also capable of gently depositing complex precursor chemicals without breaking desired bonds or the plasma can be tuned to dissociate the precursor chemicals so that the nature of the coating is quite different chemically from the precursor material.

Figure 4:
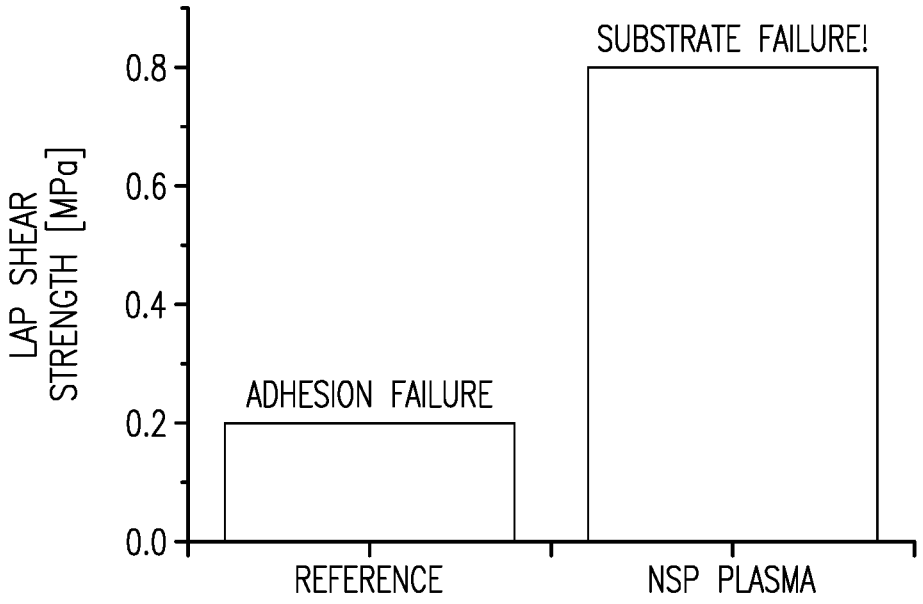
FIG. 4 is a bar graph showing lap-shear strength evaluation results from EPDM material, with (right) and without (left) plasma treatment.

As an example of the ability of the described plasma treatment system to perform desired surface activation on a temperature-sensitive substrate, FIG. 4 provides a relative strength of an adhesive bond applied between two pieces of widely used ethylene propylene diene monomer (EPDM) rubber. When the surface of the EPDM rubber was treated with the described plasma system prior to applying the adhesive, the bond strength increased by a factor of 4 relative to untreated EPDM rubber. Pulling the two pieces of the plasma treated EPDM rubber apart resulted in a tearing of the EPDM rubber material itself rather than any failure of the adhesive or its bond to the EPDM rubber. This result also clearly demonstrates that treatment of the EPDM rubber by the described plasma treatment system did not cause any thermal damage to the surface of the EPDM rubber due to excessive heat.

The surface of silicone is notoriously difficult to modify for adhesive applications. Even when silicone is successfully activated, the effect typically decays within minutes or even within seconds. The effectiveness of treatment with the described plasma treatment system for improving the strength of an adhesive bond between two pieces of silicone is shown in FIG. 5, and a time stability of the treatment of silicone with the described plasma treatment system is shown in FIG. 6.

Figure 5:
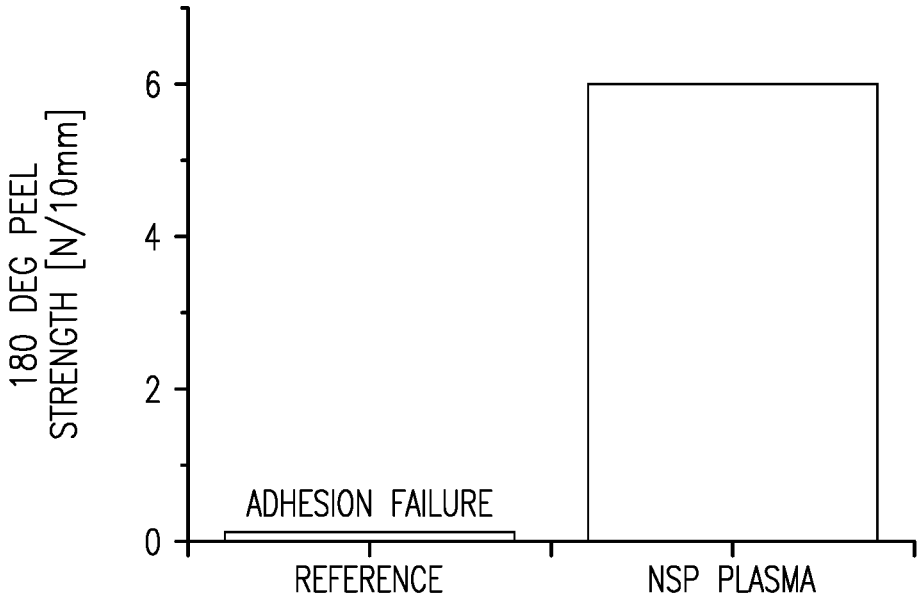
FIG. 5 is a bar graph showing 180° peel strength evaluation results from silicone material, with and without plasma treatment.

In particular, FIG. 5 shows 180° peel strength evaluation results from silicone material, with and without plasma treatment.

Figure 6:
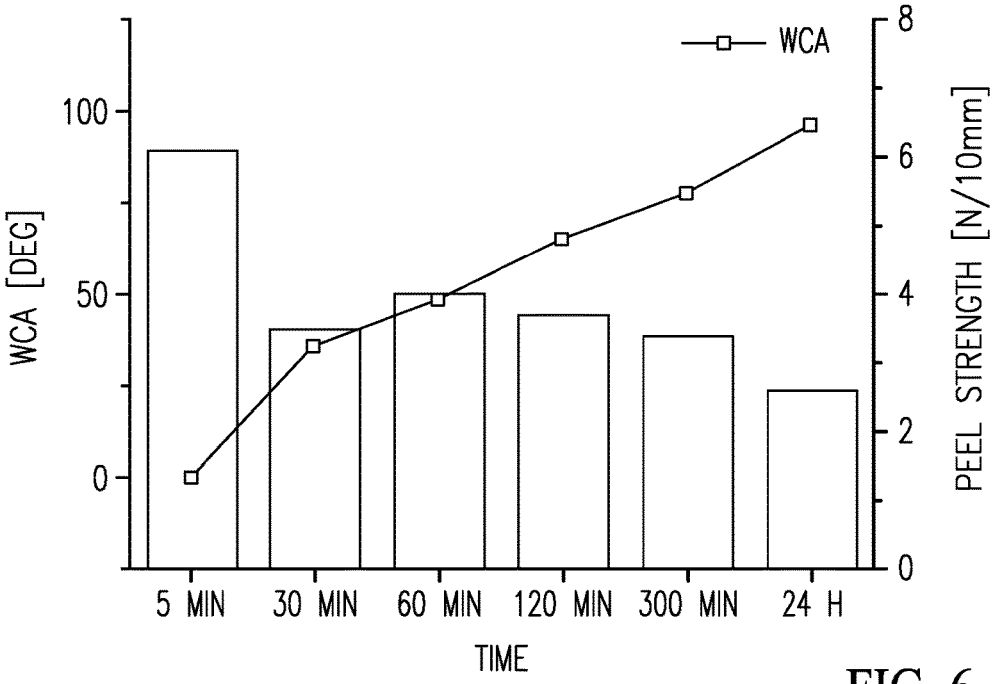
FIG. 6 is a bar graph showing a comparison of water contact angle (WCA) and peel strength over time after silicone surface activation treatment by the subject plasma treatment system.

In particular, FIG. 6 shows a comparison of water contact angle (WCA) and peel strength over time after silicone surface activation treatment by the subject plasma treatment system. A time window of five minutes appears sufficient to accomplish a bonding process resulting in higher bonding strength. Even after 60 minutes the surface activation effect was still visible, albeit slightly diminished.

Figure 3A:
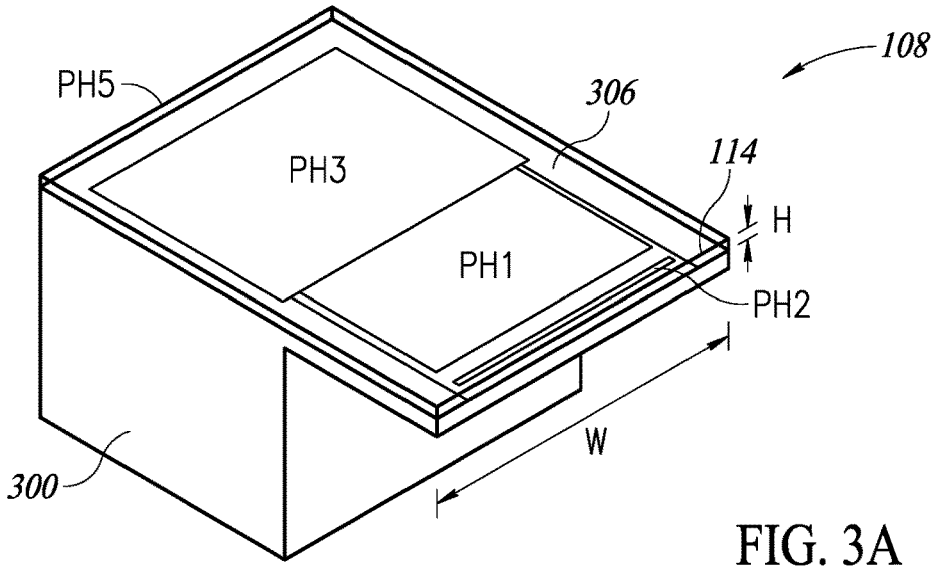
FIG. 3A is a top plan view of a plasma head, according to at least one illustrated implementation.
Figure 3B:
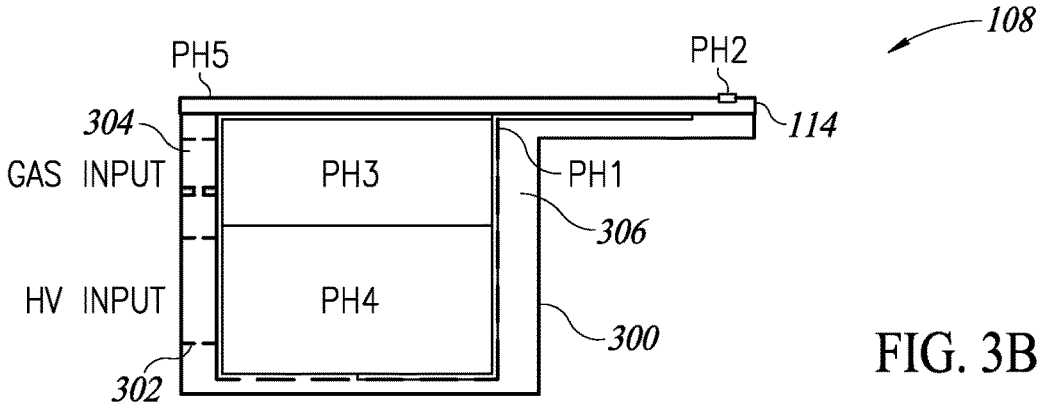
FIG. 3B is a top plan view of the plasma head of FIG. 3A.
Figure 3C:
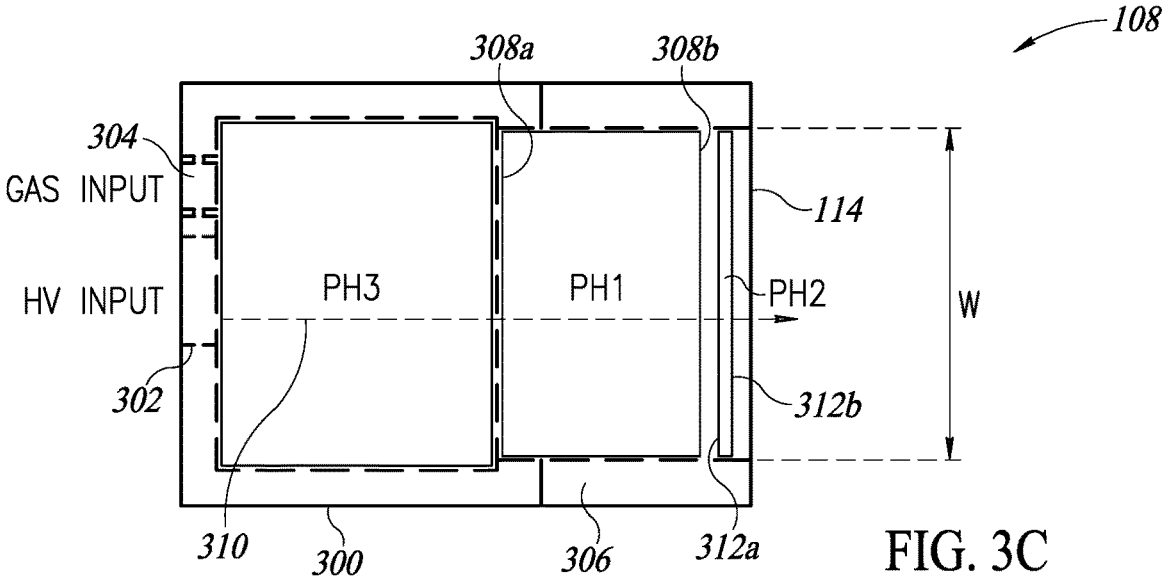
FIG. 3C is a sectional view of the plasma head of FIG. 3A

FIGS. 3A, 3B and 3C show the plasma head 108 of the plasma treatment system 100, according to at least one illustrated implementation.

The plasma head 108 includes a housing or body 300, a high voltage (HV) electrode PH1 carried by the housing or body 300, and a ground electrode PH2 carried by the housing or body 300 and spaced from the HV electrode PH1, as described below. The plasma head 108 includes a high voltage input, terminal or node 302 to electrically couple a high voltage to the HV electrode PH1, for example from a pulse generator 104 (FIG. 1) driven by a drive circuit 200 (FIG. 2). A ground input, terminal or node (not shown) electrically couples the ground electrode PH2 to a ground, for example from a pulse generator 104 (FIG. 1) driven by a drive circuit 200 (FIG. 2). The plasma head 108 preferably includes electrical insulation PH 4, to electrically insulate the HV electrode PH1 from the ground electrode PH2, as described below.

As previously discussed, the plasma head 108 includes an exit slit 114, via which gas and/or plasma 102 (FIG. 1) is dispensed or ejected from the plasma head 108. The plasma head 108 include a gas input port 304 (e.g., coupler, quick disconnect coupler, fitting) to fluidly couple a flow of gas to the plasma head 108 from a source of gas 106 (FIG. 1), for example via a hollow tube 112 (FIG. 1) with a complementary fitting at the end thereof. The plasma head 108 includes a fluid flow path in an interior 306 of the housing or body 300 that extends between the gas input port 304 and the exit slit 114, to guide a flow of gas toward the exit slit 114. The fluid flow path may be formed or defined by one or more structures, for example the housing or body 300 of the plasma head 108, a lid PH5 of the plasma head, and/or a baffle (e.g., vanes, screens, baffle material for instance nonwoven fibrous material without an ordered structure) PH3 of the plasma head 108.

The plasma head 108 is where the incoming inputs of a voltage pulse and a gas flow are joined to result in the generation of partially ionized plasma 102 (typically less than 1%) that is then delivered through the exit slit 114. Where the plasma head 108 includes a baffle PH3, the incoming gas stream is mixed in the baffle PH3 in order to provide a more uniform flow through and across the exit slit 114. Non-uniformity in the gas flow results in non-uniformity in the plasma stream 102 (FIG. 1) that exits the plasma head 108.

The exit slit 114 of the plasma head 108 has a width W (FIGS. 3A, 3B) that extends transversely to a flow of gas and/or plasma through and out of the plasma head 108. The exit slit 114 also has a height H (FIG. 3A) that extends transversely to a flow of gas and/or plasma through and out of the plasma head 108 and perpendicular to the width W, the height H being the smaller of the dimensions of the exit slit 114 relative to a dimension of the width W. The dimension of the width W of the exit slit 114 may be selected based on the particular application to which the plasma 102 (FIG. 1) will be used, for example to create a wide plasma stream, a relatively wider plasma stream than the wide plasma stream, or an relatively even wider plasma than the wider plasma stream. In at least some implementations, two or more plasma heads 108 with widths having respective dimensions that are different from one another can be provide in the form of a kit, allowing end users to select the a plasma head 108 having a width dimension that is appropriate for a given plasma task or application.

The dimension of the height H (FIG. 3A) of the exit slit 114 is kept relatively small, and may be constant across various dimensions of the width W, Maintaining a relative small height H may serve two purposes: (1) maintaining a gas flow rate sufficient to create a guiding channel for the plasma to follow, and (2) keeping the electrodes PH1, PH2 close enough to one another to generate the high electric field therebetween used to ionize the gas flow. The incoming voltage pulse is applied across the electrodes PH1, PH2 thereby creating a strong electric field between the two electrodes PH1, PH2. In addition to being separated by the gas flow, the conductive electrodes PH1, PH2 are also separated by the electrically insulating material PH5 that helps discourage arcing through the gas.

The electrically insulating material PH5 provides one of the enclosing walls or acts as a lid PH5 along which the gas and plasma flow. (The lid PH5 is shown as transparent in FIG. 3A to better illustrate the interior of the plasma head 108.) The electrodes PH1, PH2 are arranged such the resulting electric field is predominantly in the direction of the gas flow. The electrodes PH1, PH2 are also arranged such that they do not overlap or approach each other except in the region where a plasma discharge is desired. End points and corners of the electrodes PH1, PH2 may be covered with electrically insulating material in order to prevent localized regions of intense plasma generation due to field enhancement at said end points and corners. It is desirable to place the electrodes PH1, PH2 near the exit (e.g., exit slit 114) of the plasma head 108 so that as much of the plasma stream 102 (FIG. 1) as possible can exit the plasma head 108 before the plasma stream 102 relaxes to a neutral state, but one must also prevent a direct discharge or arc between the two electrodes PH1, PH2 which can happen if the plasma channel directly connects the two electrodes PH1, PH2 and is sufficiently conductive. As best illustrated in FIG. 3B, the HV electrode PH1 has a leading edge 308*a* (edge farthest upstream in the flow of gas along the flow path 310) and a trailing edge 308*b* (edge farthest downstream in the flow of gas along the flow path 310). Likewise, the ground electrode PH2 has a leading edge 312*a* (edge farthest upstream in the flow of gas along the flow path 310) and a trailing edge 312*b* (edge farthest downstream in the flow of gas along the flow path 310).

The HV electrode PH1 inside the interior 306 of the plasma head 108 is in physical contact with the gas flow and the HV electrode PH1 ends 5-10 mm from the where the plasma stream 102 (FIG. 1) exits (e.g., exit slit 114) the plasma head 108, while the ground electrode PH2 is advantageously located outside the interior 306 of the plasma head 108 and is placed at least 2 mm back from where the plasma exits (e.g., exit slit 114) the plasma head 108 and does not make contact with the gas flow which reduces the likelihood of an arc or direct discharge of the electrical energy from one electrode PH1, PH2 to the other electrode PH1, PH2, thereby reducing the effectiveness of generating plasma 102 (FIG. 1). Since atmospheric air (and similar gases) require an electric field on the order of 30 kV/cm in order to start an electrical discharge, the distance between the electrodes PH1, PH2 is typically a 2-5 millimeters so that an applied voltage of just a few kV is sufficient for ionizing the gas flow. The flowing gas helps create a channel for the propagation of the plasma stream 102 (FIG. 1). The plasma stream 102 (FIG. 1) is rapidly quenched, however, by the surrounding air as charged particles recombine and excited species relax towards lower energy states by giving energy to the surrounding air. In this implementation, the plasma stream 102 (FIG. 1) may extend outward from the end of the plasma head 108 a distance of 1 to 20 mm (typically 5 mm) before being quenched. This extension of the plasma stream 102 (FIG. 1) outside of the plasma head 108 is particularly advantageous, enabling the plasma stream 102 (FIG. 1) to potentially be used for a variety of surfaces or substrate treatments.

Figure 7:
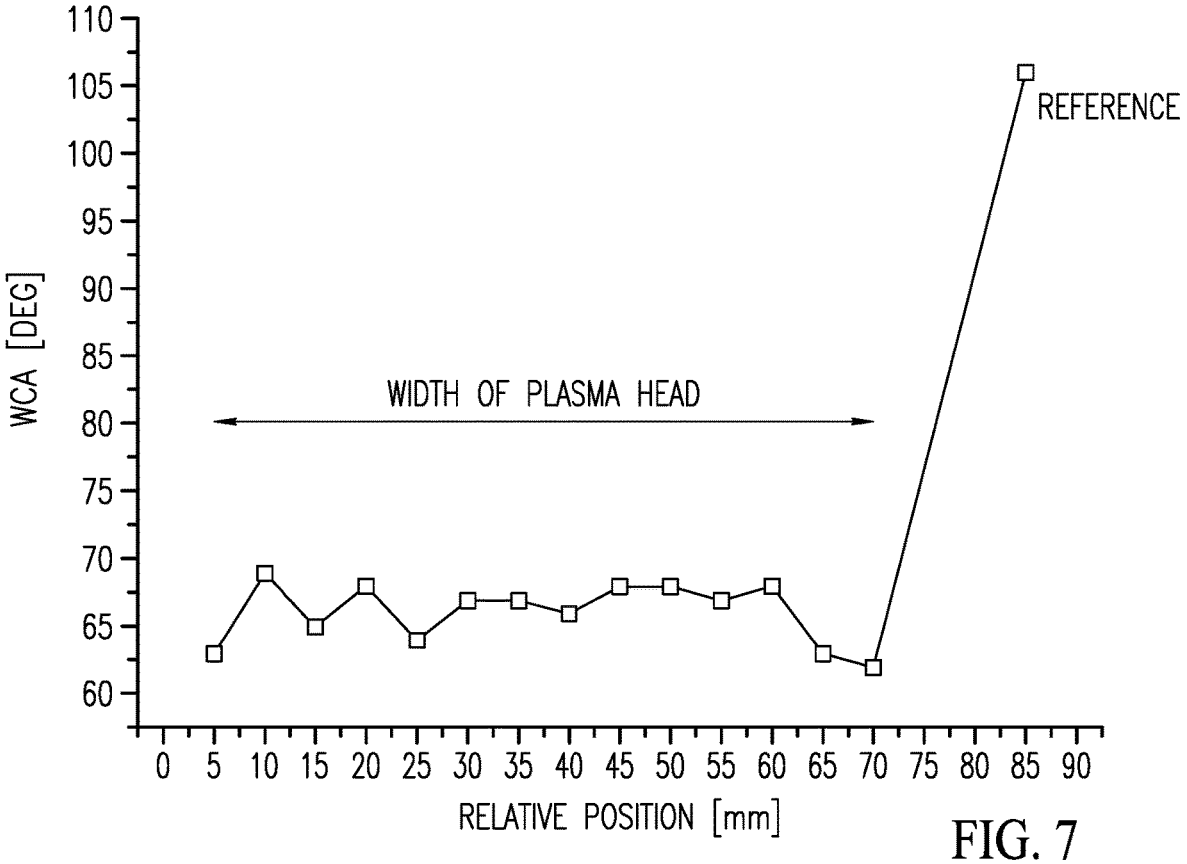
FIG. 7 is a line graph showing a WCA (Water Contact Angle) of a substrate treated by the subject plasma treatment system.

As an example of one of the benefits of the described plasma head geometry and described plasma treatment system, FIG. 7 shows a relative uniformity of surface treatment that can be achieved over a wide (70 mm) section of a substrate. In particular, FIG. 7 shows that a WCA (Water Contact Angle) of a treated substrate is relatively homogeneous across the entire 70 mm width of the plasma head. The reference point was on an untreated part of the substrate. This width is an example, and is neither an upper or lower bound to the available geometries of plasma heads.

Figure 8:
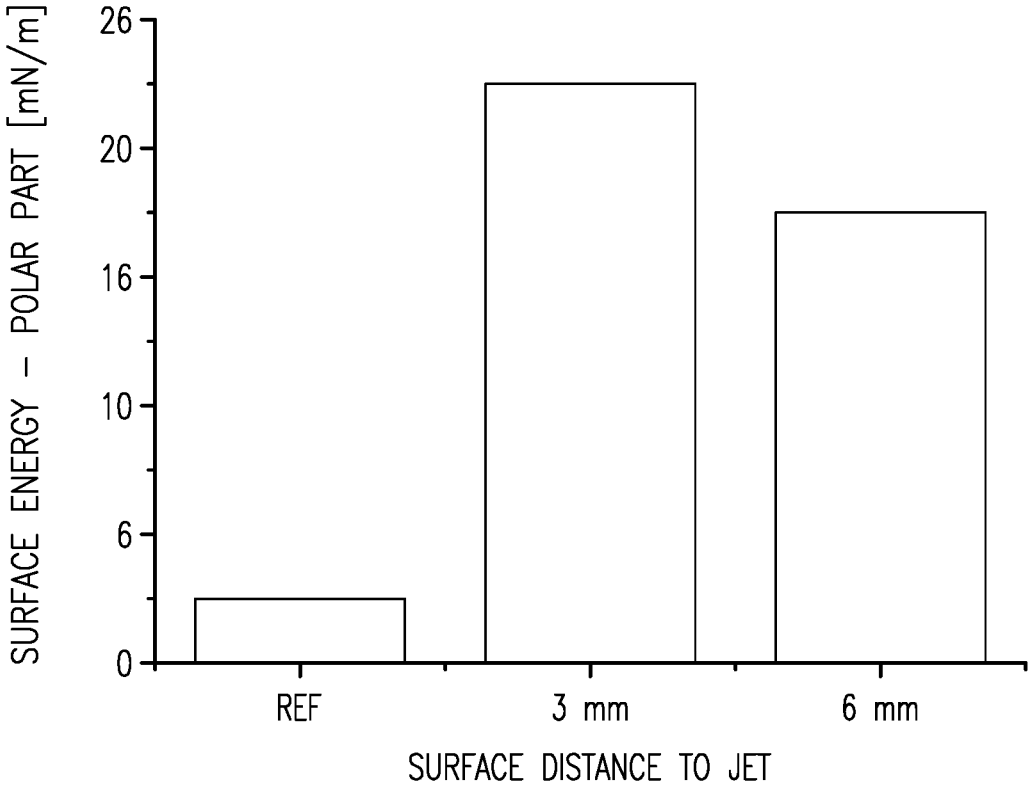
FIG. 8 is a bar graph showing a surface free energy measured after plasma treatment at various distances.

Another benefit of this plasma head geometry is the ability to effectively treat over a range of plasma head-to-substrate distances. While some atmospheric-pressure plasma treatment systems are only effective up to distances of 2-4 mm, FIG. 8 shows that the described plasma treatment system is quite effective at significantly raising a surface energy of a substrate at distances up to 6 mm. This feature enables the effective surface treatment of non-uniform or rough substrates over a range of distances that can be maintained easily, whether performed with a hand-held or robotically controlled plasma head.

Various embodiments of the devices and/or processes via the use of block diagrams, schematics, and examples have been set forth herein. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

When logic is implemented as software and stored in memory, one skilled in the art will appreciate that logic or information, can be stored on any computer readable medium for use by or in connection with any computer and/or processor related system or method. In the context of this document, a memory is a computer readable medium that is an electronic, magnetic, optical, or other another physical device or means that contains or stores a computer and/or processor program. Logic and/or the information can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with logic and/or information. In the context of this specification, a "computer readable medium" can be any means that can store, communicate, propagate, or transport the program associated with logic and/or information for use by or in connection with the instruction execution system, apparatus, and/or device. The computer readable medium can be, for example, but not limited to, an electronic, magnetic, optical, electromagnetic, infrared, or semiconductor system, apparatus, device, or propagation medium. More specific examples (a non-exhaustive list) of the computer readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

The various embodiments described above can be combined to provide further embodiments. All of the above U.S. patents, U.S. patent application publications, U.S. patent applications, foreign patents, foreign patent applications and non-patent publications referred to in this specification and/or listed in the Application Data Sheet, including but not limited to commonly owned: U.S. Pat. No. 10,072,629; U.S. patent application Ser. No. 16/254,140; U.S. patent application Ser. No. 16/254,146; U.S. patent application Ser. No. 12/703,078; U.S. provisional patent application 62/699,475; U.S. provisional patent application 62/844,587, entitled "PULSED NON-THERMAL ATMOSPHERIC PRESSURE PLASMA PROCESSING SYSTEM" and filed on May 7, 2019 and U.S. provisional patent application 62/844,574, entitled "A METHOD FOR APPLYING A PLASMA RINSE TO FINGERNAILS" and filed on May 7, 2019 are each incorporated herein by reference, in their entirety.

The various embodiments and examples described above are provided by way of illustration only and should not be construed to limit the claimed invention, nor the scope of the various embodiments and examples. Those skilled in the art will readily recognize various modifications and changes that may be made to the claimed invention without following the example embodiments and applications illustrated and described herein, and without departing from the true spirit and scope of the claimed invention, which is set forth in the following claims.

The invention claimed is:

1. A system to produce and deliver a wide beam of non-thermal, atmospheric pressure, partially ionized tunable plasma comprising:

at least one plasma head, the at least one plasma head including an exit slit and two electrodes spaced apart from one another at least proximate the exit slit and which apply a high voltage pulse across a flowing gas, wherein the exit slit has a width that extends transversely to a flow of the flowing gas and a height that extends transversely to the flow of the flowing gas and that is perpendicular to the width of the exit slit, the height of the exit slit being smaller than the width of the exit slit, a first one of the electrodes is positioned in an interior of the at least one plasma head, and a second one of the electrodes is positioned externally from the interior of the at least one plasma head, and wherein the first one of the electrodes comprises a plate that has a width that spans the width of the exit slit and that has a leading edge and a trailing edge, the trailing edge spaced downstream in the flow of the flowing gas with respect to the leading edge and the flowing gas physical contacts a surface the first one of the electrodes as the flowing gas transits from the leading edge to the trailing edge; and at least one fast rising repetitive pulse generator coupled to drive the electrodes of at least one plasma head.

2. The system of claim 1 wherein the plasma head includes a gas input to receive a flow of gas, and a flow path within the plasma head that extends between the gas input and the exit slit.

3. The system of claim 2, further comprising a gas supply fluidly coupleable to the gas input and which is variably operable both in composition and flow rate in order to achieve a set of desired plasma characteristics.

4. The system of claim 2 wherein the first one of the electrodes is positioned in an interior of the exit slit, and the second one of the electrodes is positioned externally from the interior of the exist slit.

5. The system of claim 4 wherein the trailing edge of the first one of the electrodes is positioned spaced relatively upstream of a leading edge of the second one of the electrodes with respect to a direction of flow long the flow path.

6. The system of claim 1 wherein the plasma head further includes a baffle positioned along the flow path between the gas input and the exit slit.

7. The system of claim 1 wherein the baffle comprises a baffle material without an ordered structure.

8. The system of claim 1 wherein the first one of the electrodes is a high voltage electrode, and a second one of the electrodes is ground electrode.

9. The system of claim 1, wherein the fast rising repetitive pulse generator is operable to generate high voltage pulses with rises at a rate greater than 100 V/ns, with a duration less than 100 nanoseconds, and repeatable at a user-selected frequency greater than 100 Hz.

10. A plasma head to produce in a wide beam of non-thermal, atmospheric pressure, partially ionized tunable plasma, the plasma head comprising:

a body having an interior and an exterior, a flow path, and an exit slit, the exit slit having a width and a height, the width greater than the height;

a first electrode carried by the body at least proximate the exit slit;

a second electrode carried by the body at least proximate the exit slit and spaced from the first electrode, wherein a first one of the two conductive electrodes is in the interior of the body and has a width that extends across an entirety of the width of the exit slit and has a leading edge and a trailing edge, the trailing edge spaced downstream in the flow of the flowing gas with respect to the leading edge and is in physical contact with the gas flow, and wherein the second one of the two conductive electrodes is exterior to the interior of the body and is not in physical contact with the gas flow;

at least one terminal to electrical couple at least one of the first and the second electrodes a pulse generator to receive high voltage DC voltage pulses;

at least one gas input port to fluidly couple the flow path to a source of gas;

a baffle in the flow path between the at least one gas input port and the exit slit to mix an input gas flow.

11. The plasma head of claim 10, wherein a first one of the two conductive electrodes comprises a surface positioned in the interior of the body and the surface is defined by the width of the first one of the two conductive electrodes and by the leading and trailing edges of the first one of the two conductive electrodes, the surface in physical contact with the gas flow.

12. The plasma head of claim 11 wherein the second one of the two conductive electrodes has a leading edge spaced 2 mm to 5 mm downstream from a trailing edge of the first one of the two conductive electrodes which is in the interior of the body.

13. The plasma head of claim 12 wherein the second one of the two conductive electrodes which is exterior to the interior of the body has a trailing edge that is spaced at least 2 mm upstream from exit slit of the plasma head.

14. The plasma head of claim 10 wherein a first one of the two conductive electrodes is positioned spaced relatively upstream of a second one of the two conductive electrodes with respect to a direction of gas flow long the flow path.

15. The plasma head of claim 14 wherein the first one of the two conductive electrodes is positioned from 5 mm to 10 mm upstream from the exit slit with respect to the gas flow along the flow path.

16. The plasma head of claim 10 wherein the first electrode is a high voltage electrode positioned in an interior of the plasma head, and the second electrode is a ground electrode positioned externally from the interior of the plasma head.

17. The plasma head of claim 10 wherein the baffle comprises a baffle material without an ordered structure.

18. The plasma head of claim 10, further comprising an electrically insulating material that physically separates the second electrode from the gas flow along the gas flow path.

19. The plasma head of claim 10 wherein the surface is a rectangular surface which is exposed to the gas flow in the gas flow path.

20. The plasma head of claim 10 wherein an electric field generated by the first and the second electrodes is predominately in a direction of the flow of the flowing gas along the flow path.

* * * * *